US012734399B2

(12) United States Patent
Jiang

(10) Patent No.: US 12,734,399 B2
(45) Date of Patent: Sep. 15, 2026

(54) EXERCISE DEVICE AND EXERCISE SYSTEM HAVING THE SAME

(71) Applicant: Zhipeng Jiang, Yongkang City (CN)

(72) Inventor: Zhipeng Jiang, Yongkang City (CN)

( * ) Notice: Subject to any disclaimer, the term of this patent is extended or adjusted under 35 U.S.C. 154(b) by 3 days.

(21) Appl. No.: 18/432,172

(22) Filed: Feb. 5, 2024

(65) Prior Publication Data

US 2025/0222302 A1 Jul. 10, 2025

(30) Foreign Application Priority Data

Jan. 9, 2024 (CN) ..... 202420059845.7

(51) Int. Cl.
*A63B 22/02* (2006.01)

(52) U.S. Cl.
CPC ..... *A63B 22/02* (2013.01); *A63B 2225/093* (2013.01)

(58) Field of Classification Search
CPC . A63B 22/02; A63B 22/0235; A63B 22/0207; A63B 22/0221; A63B 2225/093; A63B 22/0285
See application file for complete search history.

(56) References Cited

U.S. PATENT DOCUMENTS 11,819,730 B2 * 11/2023 Netter ..... A63B 24/0087
2004/0214693 A1 * 10/2004 Piaget ..... A63B 21/154 482/52
2012/0088633 A1 * 4/2012 Crafton ..... A63B 22/0235 482/1
2015/0250304 A1 * 9/2015 Dalebout ..... A63B 22/02 482/54
2018/0361194 A1 * 12/2018 Corbalis ..... A63B 22/0221
2019/0111318 A1 * 4/2019 Evancha ..... A63B 24/0087
2019/0192898 A1 * 6/2019 Dalebout ..... A63B 22/0605
2024/0082631 A1 * 3/2024 Stephenson ..... A63B 71/0622

OTHER PUBLICATIONS

Egofit M2 Youtube video published Dec. 8, 2023 https://www.youtube.com/watch?v=X7e3jmcA3Rg (Year: 2023).*

Egofit Walker Pro/Plus Smallest Under Desk Treadmill Walking Pad, Small & Compact Walking Treadmill with Fixed 5% Incline to Fit Desk Perfectly and Home & Office with APP & Remote Control Amazon Sales Page, date first available Mar. 14, 2021, https://www.amazon.com/dp/BOCWPBHBBH?ref=emc_s_m_5_i_atc&th=1 (Year: 2021).*

* cited by examiner

*Primary Examiner* — Megan Anderson
*Assistant Examiner* — Jonathan A Dicuia
(74) *Attorney, Agent, or Firm* — Daniel M. Cohn; Howard M. Cohn

(57) ABSTRACT

The disclosure relates to an exercise device, which includes a frame assembly, a running deck inclined at a predetermined angle relative to a base frame, a running belt, and a main cover. The inclined running deck, together with the main cover, provides space for accommodating the motor, which advantageously extends the area for the running belt. The present disclosure also provides an exercise system that includes the exercise device described above and a desk. The exercise system of the present disclosure allows users to engage in activities such as work while exercising.

5 Claims, 4 Drawing Sheets

EXERCISE DEVICE AND EXERCISE SYSTEM HAVING THE SAME

CROSS-REFERENCE TO RELATED APPLICATIONS

This application claims priority under 35 U.S.C. § 119 (a) to Chinese Patent Application No. 2024200598457, filed on Jan. 9, 2024, which is hereby incorporated by reference herein in its entirety.

TECHNICAL FIELD

The disclosure relates to the technical field of exercise equipment, in particular to an exercise device and an exercise system including the exercise device.

BACKGROUND ART

Since sitting and working in the office for a prolonged period of time may cause considerable strain to muscles and bones of the body, exercising may be required to relieve physical fatigue. However, the heavy workload does not allow the staff to exercise at the desired times. Treadmill is a popular device that people use to maintain health and alleviate the aforementioned situations. In the prior art, devices that combine an office desk with a treadmill have already emerged. These devices allow users to walk or run at a lower speed on a treadmill while simultaneously engaging in activities such as office work.

Patent application EP3388115A1 discloses a jogging desk, which includes a treadmill and a desk that is provided on a frame of the treadmill, wherein the desk can be raised and lowered relative to a guide frame.

However, constraints of office space bring challenges in terms of minimizing the footprint of the jogging desk while maximizing the running area or the length of the running belt.

SUMMARY

The present disclosure proposes an exercise device with a reasonable and practical structure. The exercise device includes: a frame assembly including a base frame; a running deck inclined at a predetermined angle relative to the base frame; a running belt surrounding the running deck; and a main cover for defining a space for accommodating a drive unit, wherein the main cover is arranged at a first end of the exercise device, and a first portion of the running deck at the first end is higher than a second portion of the running deck at a second end of the exercise device, and the second end is opposite to the first end, and wherein the main cover has an upper surface, and a maximum height of the upper surface is not higher than a maximum height of the first portion of the running belt.

In some embodiments, the maximum height of the upper surface is lower than the maximum height of the first portion of the running belt by 0.5-15 cm.

In some embodiments, the predetermined angle is in the range of 5 to 30 degrees, for example, 2 or 3 degrees. The choice of the predetermined angle depends on the size of the drive unit and/or the resistance requirements for exercise. For instance, a larger predetermined angle will provide the user with greater exercise resistance.

In some embodiments, the exercise device includes a cushioning means arranged between the running deck and the frame assembly. The cushioning means can be a cushion pad, for example, made of PVC or rubber. The cushioning means may be arranged at both side edges of the running deck, while a central region of the running deck does not come into contact with the cushioning means.

In some embodiments, the running deck is supported directly or indirectly by the frame assembly. For example, the running deck is directly supported by fixing devices of the frame assembly on both ends, wherein the fixing devices is fixed to the base plate of the frame assembly. Alternatively or additionally, the running deck can be fixed through the frame assembly on both sides. It should be appreciated that the running deck can be fixed and supported in any existing way.

The present disclosure also provides an exercise system that includes the exercise device described above and a desk. In some embodiments, the desk is an adjustable desk.

According to embodiments in the present disclosure, the exercise device is inclined, and the surface of the running deck at the front end is higher than the outer surface of the main cover or motor cover, which prevents the user's feet from unexpectedly hitting the main cover during exercise. The inclined running deck, together with the main cover, provides space for accommodating the motor, which advantageously extends the area for the running belt, especially if the available space for the exercise device is limited.

The exercise system of the present disclosure allows users to engage in activities such as work while exercising.

BRIEF DESCRIPTION OF THE DRAWINGS

The disclosure will be further explained with the attached drawings and embodiments.

DETAILED DESCRIPTION

Figure 1:
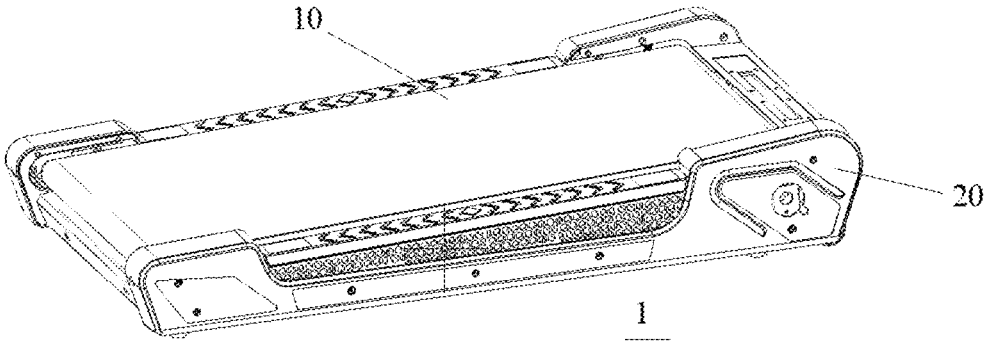
FIG. 1 shows a perspective view of an exercise device according to an embodiment.

In the following, the disclosure will be described with reference to the accompanying drawings. However, the disclosure can be embodied in many different forms and should not be construed as being limited to the embodiments set forth herein. Specifically, these embodiments are provided to fully and completely convey the content of the present disclosure and to define the scope of the present disclosure for those skilled in the art. In the drawings, the same or similar numbers represent similar elements.

FIG. 1 shows a perspective view of an exercise device 1 according to an embodiment. The exercise device 1 includes a running belt 10, which is inclined relative to a bottom surface of the exercise device 1 (or a flat ground). The exercise device 1 also includes side covers 20 arranged on both sides to protect the exercise device 1.

Figure 2:
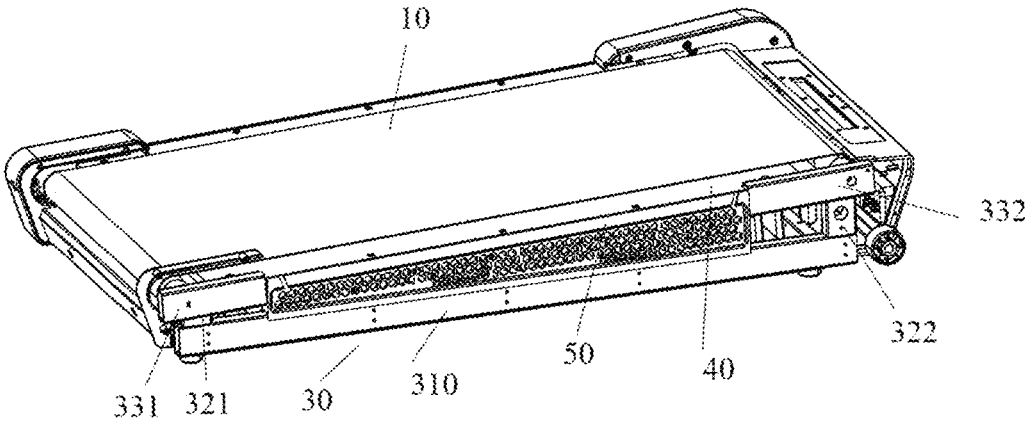
FIG. 2 shows an exercise device according to an embodiment, where one side cover is omitted.

FIG. 2 shows the exercise device 1 according to an embodiment, where one side cover is omitted. The exercise device 1 includes a running belt 10, a frame assembly 30, a running deck 40 surrounded by the running belt 10, and an optional cushioning means 50. As known by those skilled in the art, the running belt 10 is substantially parallel to the running deck 40. The frame assembly 30 includes a base frame 310, upright members 321, 322 extending upward from the base frame 310, and limiting members 331, 332 fixed to the upright members. Each of the limiting members 331, 332 (including the corresponding limiting members on the other side, which are not shown) is used to restrict the movements of the running deck 40 along a length direction of the treadmill (i.e., the direction of travel of the running belt 10) and a width direction of the treadmill (i.e., the direction perpendicular to the direction of travel of the running belt 10). The two limiting members 331, 332 on the same side are spaced apart by a predetermined distance along the length direction of the treadmill. The predetermined distance can be 50%-90%, preferably 60%-80%, more preferably 70% or 75%, of the length of the running deck 40.

As shown in FIG. 2, the running deck 40 is inclined at a predetermined angle relative to the base frame 310 of the frame assembly 30. The predetermined angle can be in the range of 2 to 30 degrees, preferably in the range of 2 to 15 degrees, more preferably in the range of 3 to 10 degrees, for example, 2 or 3 degrees. The inclined running deck 40, and the running belt 10 inclining along with the running deck 40, advantageously increase the resistance of the exercise, thereby enhancing the effectiveness of the workout.

The cushioning means 50 is arranged between the running deck 40 and the frame assembly 30 (especially the base frame 310) to attenuate the impact force exerted by the user through the running belt and the running deck. The cushioning means 50 can be made of elastic materials such as silicone, rubber, PVC, etc. In some embodiments, the cushioning means 50 is provided with bore features, such as, in a honeycomb-shaped pattern.

Figure 3:
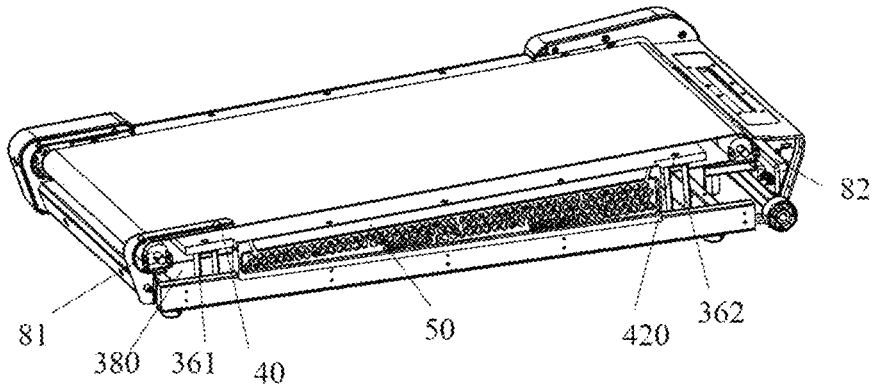
FIG. 3 shows an exercise device according to an embodiment, where upright members and limiting members are omitted.

FIG. 3 shows the exercise device 1 according to an embodiment, where upright members and limiting members are omitted. The frame assembly 30 further includes a plurality of fixing devices 361, 362 for securing the running deck 40. The plurality of fixing devices are preferably distributed at or near four corners of the treadmill 1. In some embodiments, the fixing devices are arranged at a first end (near the limiting member 331) and a second end (near the limiting member 332) of the running deck 40, and a central region and two sides of the running deck 40 (i.e., the region between the first end and the second end) are not supported. In some embodiments, the distance between a first set of the fixing devices located at the first end of the running deck 40 and a second set of the fixing devices located at the second end is 70%-95% of the length of the running deck 40, preferably 80%-90%, more preferably 85%.

The fixing devices of the frame assembly 30 can be secured to a base plate 380 of the frame assembly 30, or secured to the base frame 310 in other ways. The fixing devices 361, 362 can be solid or hollow support blocks or support pillars. The running deck 40 is fixed to each of the plurality of fixing devices, for example, using pins or screws passing through holes 420 in the running deck 40 and into corresponding holes in the fixing devices 361. Conventional fastening methods commonly used in this field are also possible.

Figure 4:
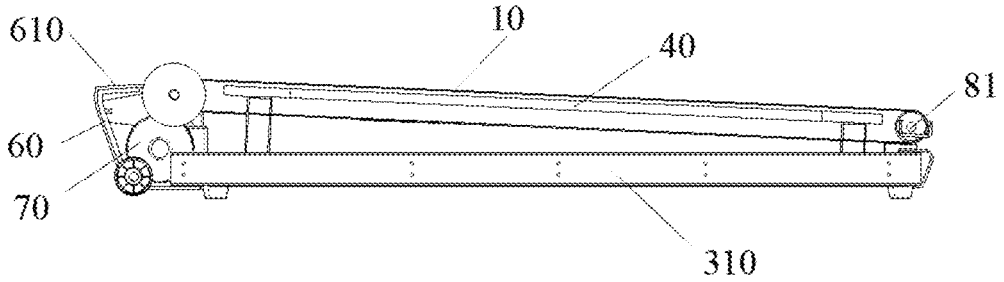
FIG. 4 shows a side view of an exercise device according to an embodiment, where some components are omitted.

FIG. 4 shows a side view of the exercise device 1, where some components are omitted. The exercise device 1 includes a main cover 60, which is located at the front end of the exercise device 1 (a portion of the running deck at the front end is higher than a portion at the rear end). The main cover 60 defines a space for accommodating a drive unit 70 (such as a motor).

Figure 5:
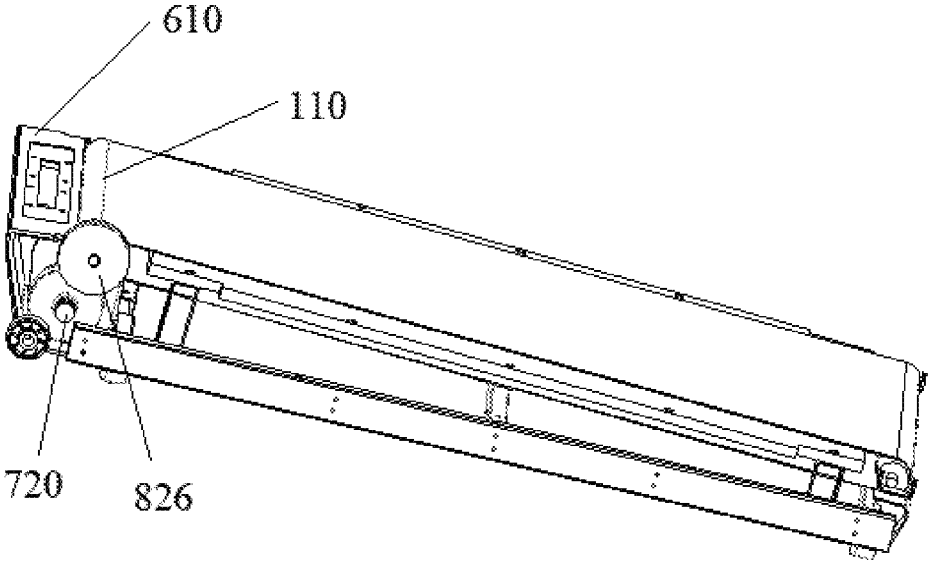
FIG. 5 shows a perspective view of the exercise device in FIG. 4.

FIG. 5 shows a perspective view of the exercise device in FIG. 4. The main cover 60 includes, for example, a horizontal or inclined upper surface 610. In some embodiments, a height of the upper surface 610 (for example, when the upper surface 610 is horizontal) or the maximum height (for example, when the upper surface 610 is inclined) is not higher than a height of a highest portion 110 of the inclined running belt 10. For example, the height or the maximum height of the upper surface 610 is lower than the highest portion 110 by 0.5-15 cm, preferably 2-10 cm, for example, 3 cm or 5 cm. Alternatively, the height of the upper surface 610 (for example, when the upper surface 610 is horizontal) or the maximum height (for example, when the upper surface 610 is inclined) is equal to or approximately equal to the height of the highest portion 110 of the inclined running belt 10.

The exercise device 1 includes rollers 81, 82 for driving the rotation of the running belt 10. The drive unit 70 may have an output shaft 720, which is connected to an additional sleeve 826 sleeved on the roller 82 by means of, for example, belt connection or gear connection. The transmission ratio between the output shaft 720 and the roller 82 is adjustable, for example, by changing the outer diameter of the additional sleeve 826 and/or the outer diameter of the output shaft 720.

The present disclosure also provides an exercise system that includes the exercise device 1 described above and a desk. Users can engage in activities such as office work while walking or running when using the exercise system. The desk can be in the form of an adjustable desk, such as the height-adjustable desk described in the patent application EP3388115A1, which is hereby incorporated by reference herein in its entirety.

Figure 6:
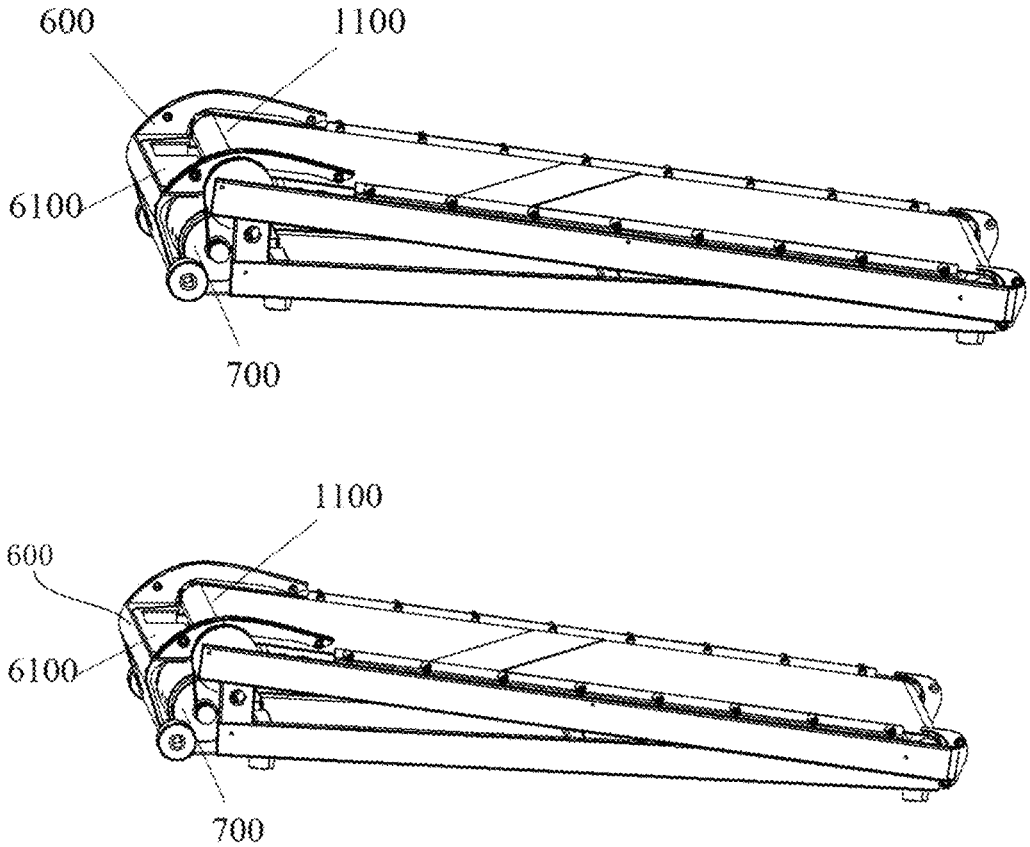
FIG. 6 shows a perspective view of an exercise device according to another embodiment.

FIG. 6 shows a perspective view of a treadmill according to another embodiment. The exercise device shown in FIG. 6 includes a main cover 600, which defines a space for accommodating a drive unit 700, wherein the main cover 600 has an upper surface 6100 that is lower than the highest portion 1100 of the running belt.

The above merely describes specific embodiments of the present disclosure, which is not intended to limit the scope of protection of the present disclosure. Any modifications, equivalent variations or substitutions, and improvements made within the spirit and principle of the present disclosure by those skilled in the art according to the disclosed technical scope should be included in the protection scope of the present disclosure.

What is claimed is:

1. An exercise device, comprising:

a frame assembly including a base frame;

a running deck;

a running belt surrounding the running deck;

a cushioning means arranged between the running deck and the base frame to attenuate the impact force exerted by the user through the running belt and the running deck, wherein the cushioning means is arranged along lateral edge regions of the running deck, while a central region of the running deck does not come into contact with the cushioning means; and a limiting installation structure comprising upright members extending upward from the base frame and limiting members fixed to the upright members, wherein each of the limiting members are used to restrict the movements of the running deck along a length direction corresponding to the direction of travel of the running belt and a width direction perpendicular to the direction of travel of the running belt, and wherein the limiting members that are adjacent along the length direction are spaced apart by a distance in the range of 50% to 90% of the length of the running deck;

wherein the running deck is fixed to the base frame only at its first and second ends of the running deck via fixing devices, such that a central region and lateral edge regions of the running deck are not in direct contact with the base frame, wherein the lateral edge regions accommodate the cushioning means and the central region remains suspended to enhance cushioning effect and stability under cooperation with the limiting installation structure.

2. The exercise device according to claim 1, wherein the cushioning means is made of elastic materials selected from silicone, rubber, PVC or a combination thereof.

3. The exercise device according to claim 1, wherein the cushioning means has an internal structure for enhanced energy absorption selected from the group consisting of honeycomb-shaped, latticed, porous, multilayered, hollow or solid elastomeric pattern.

4. The exercise device according to claim 1, further comprising a main cover for defining a space for accommodating a drive unit, wherein the main cover is arranged at a first end of the exercise device, and a first portion of the running deck at the first end is higher than a second portion of the running deck at a second end of the exercise device, and the second end is opposite to the first end, and wherein the main cover has an upper surface, and a maximum height of the upper surface is not higher than a maximum height of the first portion of the running belt.

5. The exercise device according to claim 1, wherein the fixing devices are distributed at or near four corners of the exercise device.

* * * * *